United States Patent [19]

Hauk et al.

[11] 4,340,120

[45] Jul. 20, 1982

[54] ANNULAR CASING HAMMER

[75] Inventors: Ernest D. Hauk, Yucca Valley; Jesse C. Kirkpatrick, Mission Viejo, both of Calif.

[73] Assignee: Hawk Industries, Inc., Signal Hill, Calif.

[21] Appl. No.: 161,660

[22] Filed: Jun. 23, 1980

Related U.S. Application Data

[63] Continuation-in-part of Ser. No. 888,312, Mar. 20, 1978, Pat. No. 4,232,752.

[51] Int. Cl.[3] ..... B23B 45/16; B25D 9/00; B25D 11/00; B25D 13/00

[52] U.S. Cl. ..... 173/131; 173/133; 173/134

[58] Field of Search ..... 173/131–134; 92/169; 175/135

[56] References Cited

U.S. PATENT DOCUMENTS 3,872,934 3/1975 Terada ..... 173/134

4,232,752 11/1980 Hauk et al. ..... 175/135

*Primary Examiner*—Ronald Feldbaum

*Attorney, Agent, or Firm*—Gausewitz, Carr, Rothenberg & Edwards

[57] ABSTRACT

A casing hammer for simultaneously driving casing and drilling a water well comprises a housing having an annular pneumatic chamber with an annular piston that drives an annular anvil which seals the lower end of the chamber. The chamber is formed by outer and inner sleeves of which the inner sleeve is fixed to an end cap solely at its rear end and is thus cantilevered from the end cap, being free of connection at its forward end. The forward end of the inner sleeve is stabilized by means of a relatively small clearance between the anvil and the sleeves at the front end of the chamber. The cantilevered connection of the inner sleeve at its rear end provides a smooth and unobstructed bore through which extends a rotating drill string that also extends through casing while the casing is being driven by the annular hammer.

14 Claims, 6 Drawing Figures

FIG. 4.
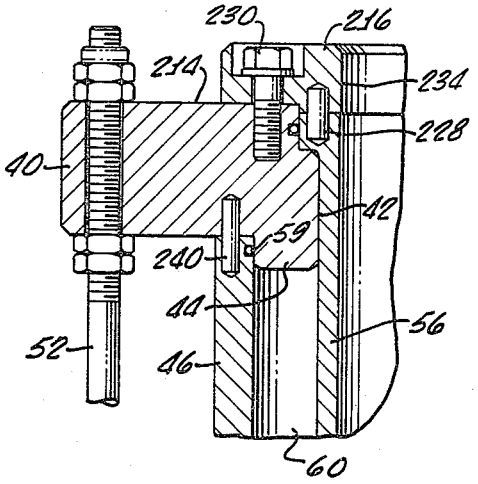
FIG. 5.
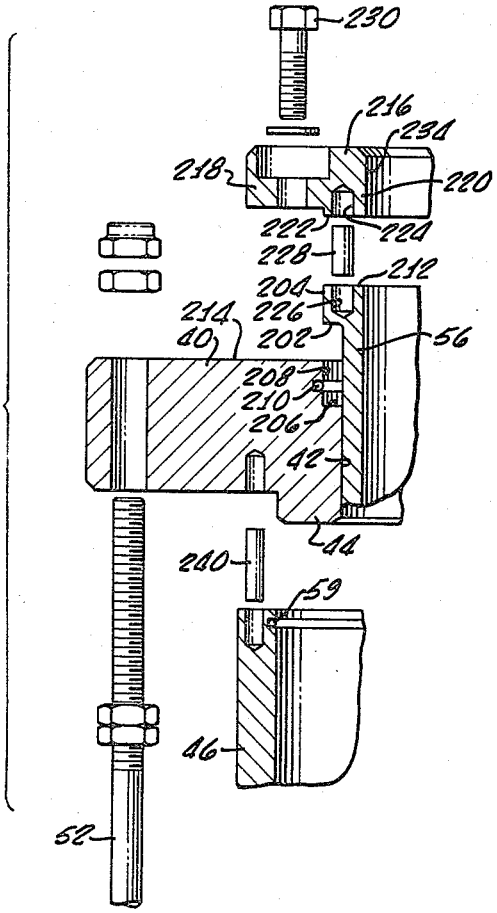
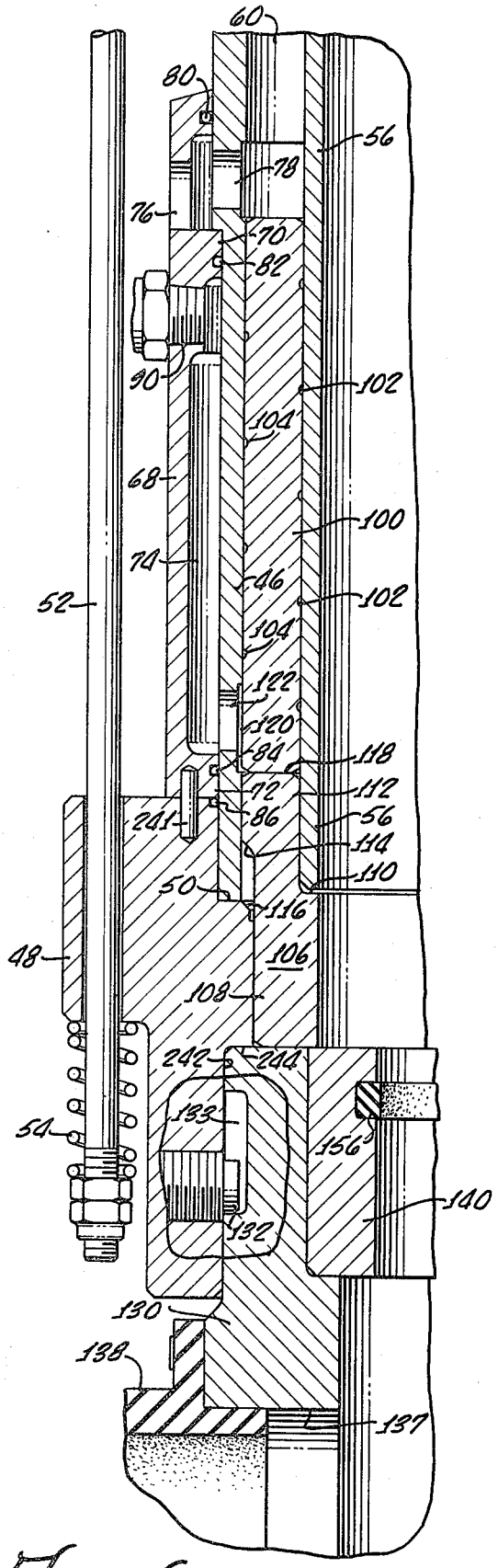
FIG. 6.

ANNULAR CASING HAMMER

This application is a continuation-in-part of our application for Method and Apparatus for Driving Pipe, Ser. No. 888,312, filed Mar. 20, 1978, now U.S. Pat. No. 4,232,752 the disclosure of which is fully incorporated herein by this reference.

BACKGROUND OF THE INVENTION

The present invention relates to apparatus for driving casing while permitting access to the casing interior, and particularly concerns improved structural arrangement of such hammer.

Our prior application, Ser. No. 888,312, describes a method and apparatus for drilling wells, particularly water wells, in which the casing is driven at the same time the well is being drilled, with fluid forced downwardly through the hollow drill string to remove loose material. The casing hammer provides an elongated annular chamber in which is mounted a piston that is pneumatically reciprocated at a relatively high repetition rate to impact upon an annular anvil captured in the hammer at the lower end of the annular chamber and transmitting piston blows to an annular driving head that rests atop a driven casing section. The annular chamber of the hammer of our prior application is formed by an outer sleeve that is held in position to and between a rear end cap and a front housing by a number of tension rods extending longitudinally of the hammer. Similarly, the inner sleeve is held to and between the end cap and a front retainer ring by a number of longitudinally extending tension rods. Debris is forced upwardly by the fluid passing downwardly through the drill string, and flows upwardly around the drill string between the drill string and the inside of the hammer. A seal at the front (lower) end of the hammer is provided to prevent such debris from entering the interior of the rear portion of the hammer, within the inner sleeve of the annular chamber. It has been found, however, that this seal is often at least partially ineffective, and thus debris and mud frequently enters the interior of the inner sleeve between the drill string and the sleeve and becomes entrapped in the inner sleeve tension rods. Such debris often fills the interior space so that rotation of the drill string tends either to rotate the inner sleeve or to twist the inner sleeve tension rods. The seal between the rotating drill string and the interior of the forward end of the hammer may wear and as it wears the leakage of debris and mud increases to aggravate this problem.

The hammer described in our prior application is constructed so that the entire weight of the hammer when it is resting upon the upper end of a casing to be driven, is transmitted through the inner sleeve of the annular chamber and thence via the anvil and driving head to the casing. This places undesirable and unnecessary strain upon the inner sleeve.

Accordingly, it is an object of the present invention to provide a pipe hammer that eliminates or minimizes above-mentioned disadvantages.

SUMMARY OF THE INVENTION

In carrying out principles of the present invention in accordance with a preferred embodiment thereof, the inner sleeve of an annular pipe hammer has its rear end rigidly fixed to the end cap and its front end free of connection to the end cap. With such rigid cantilevered connection of the rear end of the inner sleeve to the end cap, close clearance between the front chamber end sealing anvil and the two sleeves is sufficient to stabilize the free front end of the inner sleeve and to maintain concentricity of the sleeves. A preferred rigid cantilevered connection between the end cap and the rear end of the inner sleeve is provided by interengaging shoulders on the two that are clamped together by an annular sleeve retainer cap. Thus, the interior of the inner sleeve is clear and unobstructed by any sleeve mounting or connecting devices, a minimum of material and parts is employed for such connection, and yet the sleeve position is retained with adequate precision.

According to another feature of the invention, the front housing and the drive head of the hammer are provided with interengaging surfaces that permit the front housing to rest directly upon the drive head thus transmitting hammer weight through the outer sleeve and housing instead of through the inner sleeve.

BRIEF DESCRIPTION OF THE DRAWINGS

FIG. 4 is an enlarged fragmented sectional view of the cantilevered mounting of the inner sleeve to the end cap, FIG. 5 is an exploded view of the inner sleeve end and its connection, and FIG. 6 is an enlarged fragmentary view of front or low portions of the hammer.

DETAILED DESCRIPTION

Figure 1:
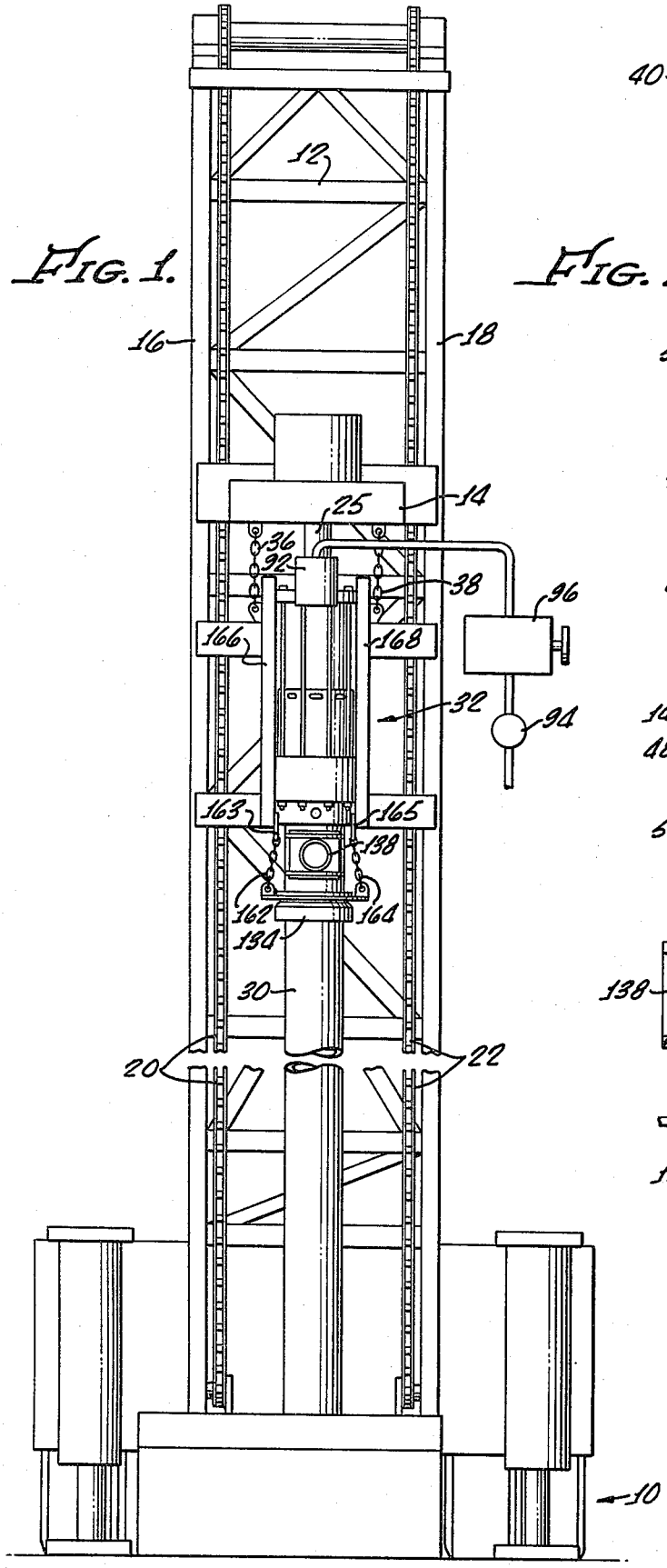
FIG. 1 illustrates a portable drilling rig of conventional construction mounting a pipe hammer embodying principles of the present invention.
Figure 2:
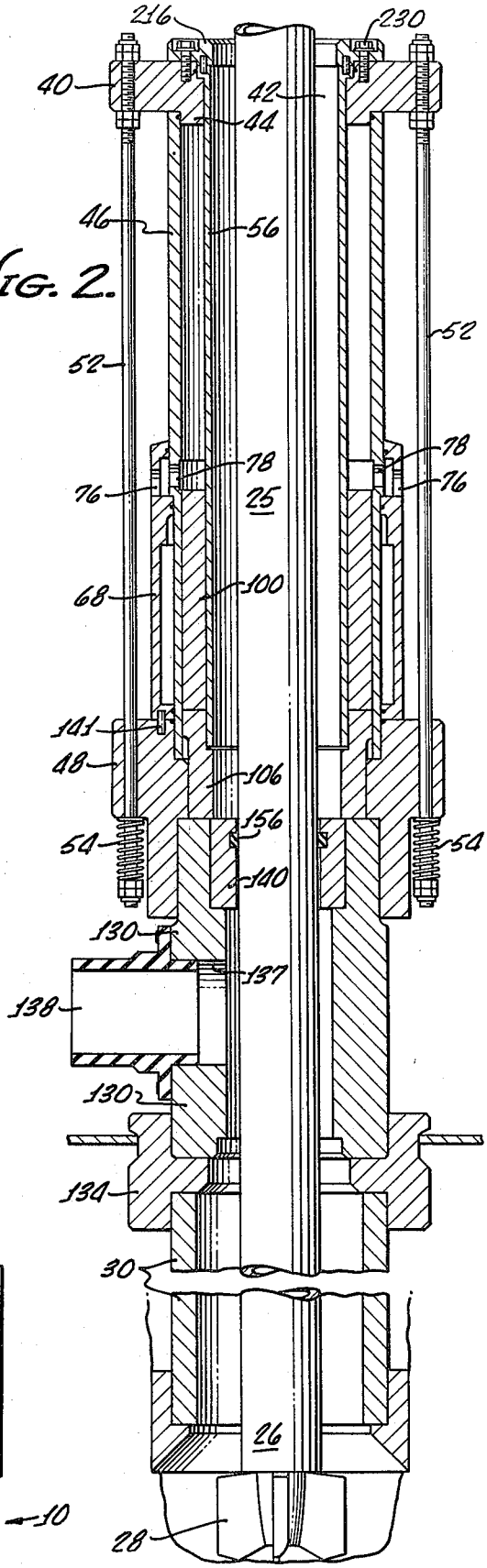
FIG. 2 is an enlarged sectional view of the hammer illustrating the relation of drill string casing and hammer and omitting the supporting rig.

As illustrated in FIG. 1 a conventional drilling rig is mounted on a vehicle 10 and includes a frame 12 that is positioned generally vertically when in operation. The vehicle and frame are conventional and details thereof form no part of this invention. Briefly, a cross head 14 is slidably mounted in upright guide tracks 16, 18 that extend substantially the length of the frame. The cross head is carried by continuous chain 20, 22 entrained over chain wheels (not shown) at the top and bottom of the frame. Means, not shown, are provided to move the chain and thereby raise the cross head and permit it to be lowered. In the conventional rotary drill rig the cross head mounts a rotary drive which includes a downwardly extending hollow stub 25 detachably connected to the uppermost section of conventional hollow drill string 26 having at the lowermost end of the string a conventional rotary drill bit 28 (FIG. 2). Suitable conduits (not shown in FIG. 1) carry power to the cross head for rotation of the stub and drill string and for supplying air under pressure to the interior of the drill string.

Where well casing is to be driven while the well is being drilled, and as is now practiced in drilling of water wells, a length of casing 30 surrounds the drill string and extends upwardly to a point adjacent the upper end of the string. Interposed between the upper end of the casing 30 and the rotary cross head 14, and circumscribing the stub 25, is a hammer, generally indicated at 32, embodying principles of the present invention. The hammer is suspended, to be raised when necessary, by means of a pair of short chains 36, 38 connected between the upper end of the hammer and the lower side of the rotary cross head. The hammer is also guided for vertical movement along the guide tracks 16, 18.

The hammer basically comprises a housing having a central bore and an annular chamber closed at its rear (normally upper) end and slidingly mounting a sealing anvil at the other end. The anvil is directly struck by a reciprocating piston so as to be driven a short distance outwardly of the forward (normally lower) end of the chamber.

The hammer housing is formed of an end plate or cap 40 (FIGS. 4, 5, 6) having a central bore 42 and an annular rib 44 projecting forwardly from a forward face thereof. An outer sleeve in the form of a right circular cylinder 46 has its rear end butted against the forward surface of the cap 40 and against the outer peripheral face of the rib 44. A forward housing 48 of generally annular configuration has the inside of its rearward end enlarged to provide a seat 50 that butts against the forward end of the outer sleeve 46. A plurality of tensioning tie rods 52 extend entirely through the front housing, rearwardly along the exterior of the outer sleeve and through the end cap, drawing the end cap toward the front section by means of enlarged heads or nuts on the forward end of the tie rods and nuts on the rear ends. To absorb some of the shock loads imparted to the housing, each tie rod has a spring, such as spring 54, compressed between its lower or forward end and the forward end of the front housing.

An inner sleeve in the form of a right circular cylinder 56 is concentric with the outer sleeve 46 and has its rear end fixedly connected to the end cap in a manner more particularly described below. The forward end of the inner sleeve is free of any connection to the end cap 40, being cantilevered from its fixed rear end connection to the end cap. This free forward end is stabilized by a closing fitting annular anvil 106. A sealing O-ring 59 is interposed between the face of rib 44 and the adjoining surface of the outer sleeve to seal one side of the rear end of the annular chamber 60 which is formed between the concentric sleeves.

A return chamber body 68 circumscribes the outer sleeve and has upper and lower radially inwardly directed peripheral flanges 70, 72 that abut the outer surface of the outer sleeve to space the main chamber body portion away from the outer sleeve, thereby to define an air return chamber 74 between the chamber body 68 and the outer surface of the outer sleeve. Chamber body 68 is formed with a plurality of radially outwardly directed ports 76, which are not in communication with the chamber 74, but are in communication with a plurality of apertures 78, extending radially through the outer sleeve 46 substantially midway between the upper and lower sections of the annular chamber 60. The return chamber body 68 is sealed to the outer sleeve by means of O-rings 80, 82 and 84, and a further O-ring 86 seals the front housing 48 to the chamber body 68 and to the outer sleeve 46.

Figure 3:
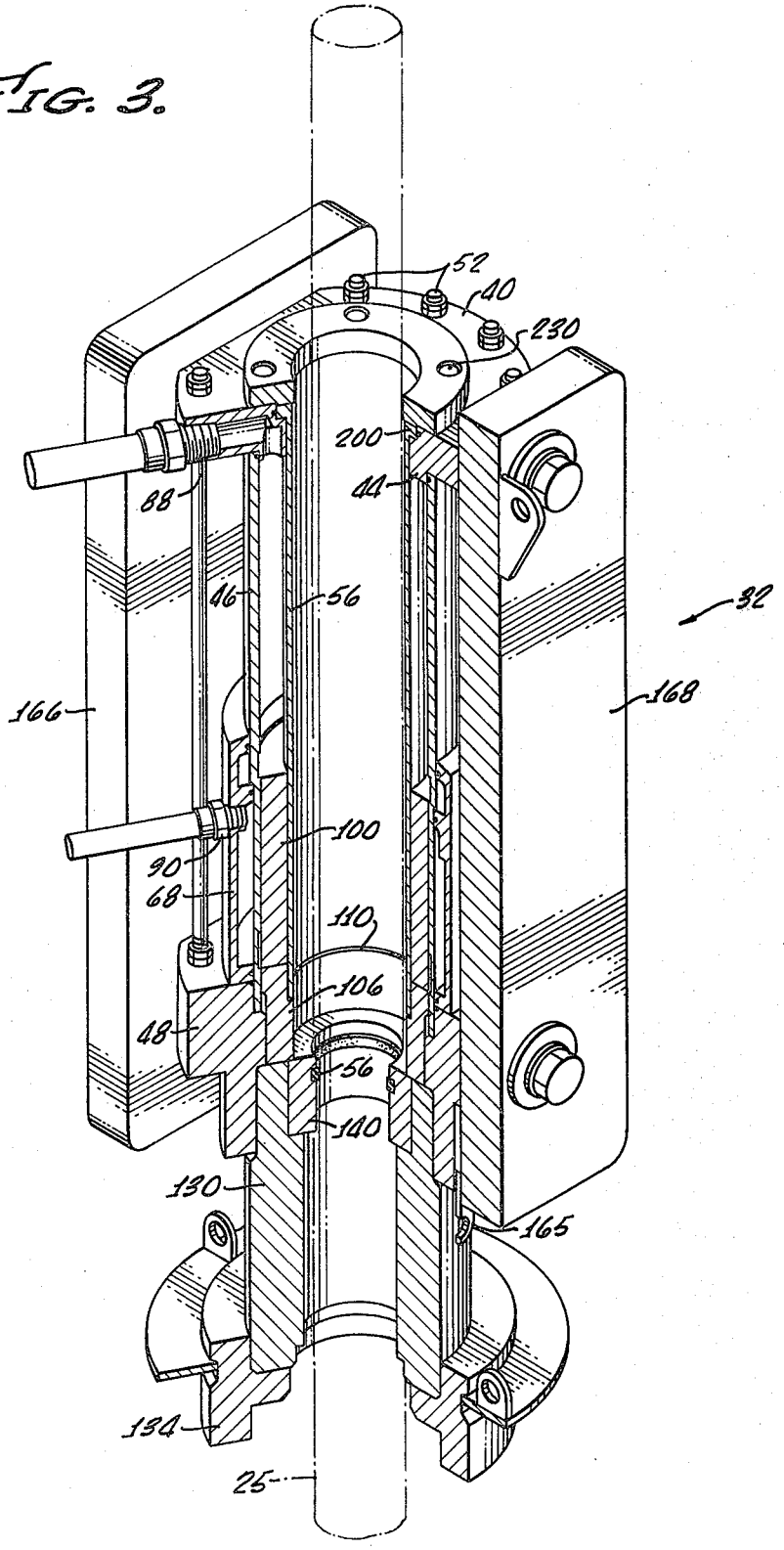
FIG. 3 is a perspective view of the hammer with parts broken away.

Air hose fittings 88,90 (FIG. 3) connect chambers 60 and 74 to air hoses and pneumatic control valve 92 (FIG. 1), which is supplied with pressurized air from a source (not shown) via a gage 94 and pressure regulator 96.

An annular piston 100, having a length somewhat less than half the length of the annular chamber, is slidably mounted therein and is formed with a plurality of peripheral grooves such as indicated at 102, 104 on both inner and outer surfaces to entrap air and oil for lubrication of the sliding motion of the piston in the annular cylinder. The piston forms the ram of this hammer and is driven at a high rate of reciprocation, the speed of the ram and the supplied air pressure primarily determining the impact energy that is imparted to the driven casng, all as described in detail in our prior co-pending application.

The lower end of the annular chamber 60 is sealed by means of the annular anvil 106 which is mounted for limited sliding motion within the annular chamber. The anvil has a forward driving portion 108 that is positioned outwardly of the chamber 60 and is formed with a rearwardly facing shoulder 110 that is adapted to approach or engage the forward facing end of inner sleeve 56 to limit motion of the anvil inwardly of the chamber 60 (toward the rear of the hammer). The rearward end 112 of the annular anvil is formed with an outer peripheral enlargement having an inclined forwardly facing shoulder 114 that cooperates with an inclined rearwardly facing shoulder 116 on the inner surface of the front housing 48 to provide a stop that limits forward motion of the anvil and prevents the anvil from sliding completely out of the chamber. The rear face of the anvil is rounded or chamfered on both inner and outer edges, as indicated in the drawing, and is adapted to be directly struck by the forward face of the piston which likewise is rounded or chamfered on both inner and outer edges, as shown.

When the hammer is at rest upon a casing to be driven, the chamber sealing anvil is in its maximum retracted position. The plane of contact 118 between the piston and anvil is positioned slightly to the rear of the forward end of a peripheral recess 120 formed in the inner surface of the lower end of the outer sleeve 46. Annular recess 120 communicates with the return chamber 74 by means of circumferentially spaced apertures 122 extending through the outer sleeve wall.

The forward end of the front housing extends forwardly of the forward end of the anvil. An annular drive head 130 is slidably mounted within this forward portion of the front housing, having its outer surface dimensioned to be a sliding fit upon the inner surface of the front housing. Drive head 130 is slidably retained in the housing by a plurality of bolts 132 which are threaded through the housing and extend into peripherally spaced recesses 133 formed in the outer surface of the drive head. The recess extends axially for a distance sufficient to permit limited relative sliding motion of the drive head and front housing.

The lower end of drive head 130 is received within the rear end of an adapter collar 134 as described in our above identified co-pending application. The collar is adapted to seat upon and transmit percussive blows to the upper end of a casing 30 (FIG. 2) that is to be driven by the hammer. Different adapter collars are employed with casing of different diameters. All adapters have the same dimensions at the rear for receiving the forward end of the driving head, but have forward sections dimensioned to accommodate a specific casing size.

Drive head 130 has a discharge aperture 137 in which is mounted a discharge fitting 138.

The internal surface of the drive head to the rear of the discharge fitting 138, carries an annular seal bushing 140 which receives and retains an annular seal 156 protruding radially inwardly to abut and seal against the outer surface of a length of drill string that extends through the hammer and through the casing 30.

Adapter collar 134 is suspended from the housing by means of a pair of short chains 162, 164 (FIG. 1) connected to and between the collar and the front end of the front housing. During operation of the hammer the chains take no load and the entire hammer is supported by the collar upon the casing. Ballast plates 166, 168, (FIG. 3) which provide pre-loading of the hammer, are bolted to the end cap and front housing respectively. The collar supporting chains are connected to apertured brackets 163, 165 welded to the front of the hammer, at the front of the ballast plates, and to apertured ears on the collar.

Each ballast plate has fixed thereto forward and rear laterally extending brackets that fixedly carry mutually spaced guide angles slidably receiving vertical tracks to guide the hammer in its vertical motion.

Pneumatic valve 92 is fixedly carried by the end cap 40 and spaced radially outwardly from the hammer centerline to allow the drill string to pass through the hammer. The valve employs a shuttle that is automatically cycled by pressure differential in valve chambers that are connected to opposite ends of the piston chamber above and below the piston. Details of the valve and its operation of reciprocate the piston are set forth in our above-identified copending application. Other types of valves and various conventional valves may be used as deemed necessary or desirable.

In use of the described hammer for combined drilling and casing driving, fluid is forced downwardly through the hollow drill spring to carry debris, mud and the like upwardly through the casing between the inside of the casing and the outside of the drill string. The debris is discharged through aperture 137 and discharge fitting 138 of the drive head 130. This upwardly flowing debris is desirably prevented from flowing into the interior of the hammer, into the bore of the inner sleeve 56, by means of the seal 156. However, it is difficult to maintain a tight seal between the drive head and the rotating drill string, and debris, mud and the like that leaks upwardly past such seal will tend to accumulate within the interior of the inner sleeve. In the hammer arrangement of our co-pending application, the inner sleeve is secured to the end cap by use of a forward annular retainer and a number of inner tie rods connected to and between such retainer and the end cap, and extending within the bore of the inner sleeve. In such arrangement the debris and mud tend to accumulate and to become packed in and about the tie rods and to be more readily retained within the bore because of the presence of the tie rods. Eventually the accumulation of mud within the inner sleeve bore is packed tight enough to transmit some of the torque of the rotating drill string to the tie rods and thus to the inner sleeve. This packed debris is difficult to dislodge from the inner tie rods and the transmitted torque produces undesirable strain on the hammer.

This problem is eliminated in the present construction by providing a unique cantilevered connection between the rear (upper) end of the inner sleeve and the end cap, thus eliminating the tie rods and the forward retainer that were used in the prior hammer to stabilize the position of the front end of the inner sleeve. The unique rigid connection of the present invention, a cantilevered connection without any connection of the forward end of the inner sleeve to the rear end cap, provides an unexpected and surprising stabilization of the free end of the inner sleeve by means of a small clearance of the chamber sealing anvil, all without need for any tie rods or similar connecting elements in the interior of the inner sleeve. Thus, the bore of the inner sleeve remains clear and unobstructed of connecting elements.

Details of the unique rigid cantilevered connection of the rear end of the inner sleeve to the end cap are best seen in FIGS. 4 and 5. The rear end of the end cap is provided with an annular radially outward circumferential projecting portion or flange 200 (FIG. 3), having a forwardly facing annular shoulder 202 and an outwardly facing annular sealing surface 204. Shoulder 202 seats upon an upwardly facing inner annular shoulder 206 formed on the inner side of the end cap by means of an enlargement 208 of end cap bore 42 at the rear side of the end cap. The enlarged bore portion 208 carries an O-ring 210 which presses against the outwardly facing surface 204 of the inner sleeve to seal this side of the rear end of the chamber 60. The rearmost end 212 of inner sleeve 56 terminates just forwardly of the rear surface 214 of end cap 40.

An annular sleeve retainer cap 216 has an outer peripheral portion 218 that overlies (to the rear of) end cap surface 214 and includes an annular forwardly projecting inner portion 220 that is a close fit within the enlarged cap bore portion 208. Retainer cap 216 has a forwardly facing surface 222 that bears directly upon the rearwardly facing end surface 212 of the inner sleeve 56. Sleeve retainer cap portion 220 and the rearmost end of the inner sleeve 56 are formed with complimentary mating recesses or blind holes 224, 226 that receive an anti-rotation pin 228 extending from the sleeve to the cap retainer and bridging the junction therebetween. A plurality of such recess and anti-rotation pins are provided spaced circumferentially about the rear end of the inner sleeve. These resist any tendency of the inner sleeve to rotate about the axis of the hammer relative to the outer sleeve and/or the end cap.

A plurality of circumferentially spaced bolts 230 extend through the cap retainer 216 and are threadedly received in the body of end cap 40. Sleeve retainer cap portion 220 is sufficiently long (axially of the hammer) so that when the bolts 230 are tightened, surface 222 of the sleeve retainer cap bears tightly against surface 212 of the inner sleeve to forcibly clamp the sleeve and cap shoulders 202 and 206 against each other, thus rigidly clamping the sleeve projection 200 to the end cap 40.

If deemed necessary or desirable, a single anti-rotation pin 240 may be captured in corresponding mating and axially extending blind holes formed in the end cap 40 and in the rearmost end of the outer sleeve 46 to ensure against rotation of the outer sleeve relative to the end cap. In a preferred embodiment only one such pin 240 is employed whereas four pins 228 for restraining rotation of the inner sleeve are employed. In addition, an anti-rotation pin 241 (FIG. 6) is captured in mating blind holes formed in a rearwardly facing surface of front housing 48 and a forwardly facing surface of chamber body flange 72 for resisting relative rotation of the outer sleeve and front housing.

It will be seen that with the connection described above, the inner sleeve is rigidly connected to the end cap, yet a minimum amount of material and a minimum number of parts are employed. Further, the inner sleeve bore is clear and unobstructed except for the fact that the inner surface 234 of the sleeve retainer cap 216 may have a diameter slightly less than the inner diameter of the sleeve 56 so as to provide some protection for the inner sleeve against abutment with and abrasion by the drill string.

Piston 100 reciprocates vertically within the chamber 60 and has a diametral clearance within the chamber of 0.010 to 0.012 inches. In other words, as viewed in longitudinal cross section, the thickness of the piston on one side of the hammer is less than the radial distance between the inner surface of the outer sleeve and the outer surface of the inner sleeve by 0.005 to 0.006 inches.

It is significant that the anvil portion 112, captured within the chamber 60 between the sleeves, has a clearance that is smaller than the clearance of the piston. In a presently preferred embodiment, the diametral clearance of the upper portion of the anvil is from 0.006 to 0.008 inches. In other words, the thickness of a section of the anvil is less than the radial distance between the sleeves by 0.003 to 0.004 of an inch. This smaller clearance of the anvil provides sufficient clearance to allow the relatively small vertical reciprocation (in the order of one inch or less) required of the anvil during hammer operation and yet provides sufficient stabilization of the free cantilevered forward end of the inner sleeve when the latter is connected at its rear end as described above. Concomitantly, the greater clearance afforded the piston, which reciprocates vertically through a significantly greater distance than does the anvil, helps to avoid contact of the piston against chamber walls and to avoid galling of the piston.

In the prior hammer, weight of the hammer, including its ballast, was transmitted through the inner sleeve to the front end annular retainer on the end of the inner sleeve, thence to the shoulder 110 of the anvil and thence to the driver, adaptor collar and casing. This places undue and undesired strain upon the inner sleeve which has a thinner wall than the outer sleeve 46. According to the present arrangement, the front end of the bore of the front housing is cut away to provide an enlarged bore section 242 (FIG. 6) and forwardly facing inner shoulder 244 on the front housing which rests upon the rearwardly facing outer end of driver or drive head 130. The arrangement is such that with the housing shoulder 244 resting upon the rear end of the drive head, the forward end of the inner sleeve 56 is spaced slightly to the rear of the anvil shoulder 110 and thus the entire weight of the housing is no longer carried through the inner sleeve, but instead is carried through the stronger outer sleeve to the front housing and thence, via shoulder 244, to and through the driver and to the collar and casing.

Since both the sleeve retainer cap projection 220 and the inner sleeve rear end projection 200 are a close fit and abut against the longitudinally extending surface of enlargement 208 of the end cap bore, the sleeve retainer cap and the enlarged rear end of the inner sleeve are positioned in precise longitudinal alignment, thus facilitating and enhancing the clamping action by which the bolts 230 cause the sleeve retainer cap to press longitudinally and forwardly against the rear end of the inner sleeve.

There have been described structural details of an improved annular pipe hammer which employs a unique rigid cantilevered connection of an inner sleeve of its annular chamber to provide a clear and unobstructed hammer bore in a hammer of great durability, fewer components, less material and simplified assembly.

The foregoing detailed description is to be clearly understood as given by way of illustration an example only, the spirit and scope of this invention being limited solely by the appended claims.

What is claimed is:

1. A pipe hammer comprising an end cap, an outer sleeve fixed to said end cap, an inner sleeve having a rear end rigidly fixed to said end cap, said inner sleeve being concentric with and in radially spaced relation to said outer sleeve to define an annular chamber closed at one end by said end cap, the front end of said inner sleeve being free of connection to said end cap, an annular piston slidably mounted in said chamber with a radial piston clearance between said piston and said chamber, an annular anvil slidably mounted in and sealing the other end of said chamber and having radial anvil clearance between said anvil and said chamber that is less than said piston clearance, said anvil clearance being sufficiently small to cause said anvil to radially position said sleeves relative to each other at said other end of the chamber to maintain concentricity of said sleeves and to stabilize the free front end of said inner sleeve, means for reciprocating said piston within said chamber to cause the piston to repetitively strike said anvil, and means for receiving blows from said anvil and transmitting such blows to a pipe to be driven.

2. The pipe hammer of claim 1 including an axially facing inner shoulder formed on said end cap, an outer axially facing shoulder formed on an end of said inner sleeve adjacent said closed chamber end, and means for holding said shoulders in tight engagement with each other to fix said inner sleeve to said end cap.

3. The pipe hammer of claim 2 including means for restraining relative rotational motion between said inner sleeve and end caps.

4. The pipe hammer of claim 2 wherein said means for holding said shoulder in engagement comprises a sleeve retainer cap fixed to said end cap and pressing against an end of said inner sleeve.

5. The pipe hammer of claim 4 wherein said means for restraining radial motion comprises mating recesses formed in said inner sleeve and said sleeve retainer cap, and a pin in said recesses bridging said inner sleeve and sleeve retainer cap.

6. The pipe hammer of claim 1 including a front housing abutting said outer sleeve at said other end of said chamber, tension means connected to and between said end cap and front housing to fix said outer sleeve to said end cap, an annular driving head slidably carried by said front housing and having an upper end adapted to be engaged by said anvil, said driving head having an upper end extending radially outwardly of said anvil, said front housing having a downwardly facing inner shoulder seated upon said outwardly extending end of said driving head, whereby weight of said sleeves, cap and front housing is transmitted directly to said driving head by said front housing.

7. A pipe hammer for driving casing, said pipe hammer comprising a rear cap having a bore, an outer sleeve having a rear end seated on said rear cap and coaxial with said bore, a front housing on the front end of said outer sleeve, means for securing said front housing to said rear cap to fix said outer sleeve to said rear cap, an inner sleeve positioned coaxially of said bore, and having a radially outwardly projecting portion, means for rigidly fixing said projecting portion to said rear cap, said sleeves defining an annular chamber closed at the rear end of said sleeves by said rear cap, an annular anvil positioned between said sleeves at the front ends thereof in sealing relation to said chamber, said anvil having a limited slidable motion within said chamber, an annular piston slidably positioned within said chamber, means for reciprocating said piston within said chamber and causing it to repetitively strike said anvil, and means for transmitting blows from said anvil to casing to be driven by said hammer.

8. The pipe hammer of claim 7 wherein the radial spacing of said sleeves defines a radial chamber dimension, said piston having a radial thickness less than said chamber dimension to provide a piston clearance, said anvil having a radial thickness between said sleeves less than said chamber dimension to provide an anvil clearance less than said piston clearance, the front of said inner sleeve being free of connection to said housing and rear cap, whereby said anvil stabilizes the front of said inner sleeve.

9. The pipe hammer of claim 7 wherein said means for fixing said projecting portion comprises a shoulder on said rear cap engaging said portion and an annular sleeve retainer fixed to said rear cap and pressing said portion against said shoulder.

10. The pipe hammer of claim 7 including an annular driving head slidably carried by said housing and having an upper end adapted to be engaged by said anvil, said driving head having an upper end extending radially outwardly of said anvil, said housing having a downwardly facing inner shoulder seated upon said outwardly extending end of said driving head, whereby weight of said sleeves, cap and housing is transmitted directly to said driving head by said housing.

11. An annular pipe hammer for driving casing that has a rotary drill string extending through the casing, said hammer comprising an end cap, an outer sleeve fixed to said end cap, an inner sleeve fixed to said end cap only at the rear end of the inner sleeve and having a free forward end, said inner sleeve being in radially spaced relation to said outer sleeve to define an annular chamber closed at one end by said end cap, said inner sleeve defining a bore for drill string extending through said hammer, said bore being clear and unobstructed, an annular piston slidably mounted in said chamber, an annular anvil slidably mounted in and sealing the other end of said chamber, means for radially positioning said sleeves relative to each other at said other end of the chamber to maintain concentricity of said sleeves, said means for positioning comprising a first clearance between said piston and said sleeves and a second clearance smaller than said first clearance between said anvil and said sleeves, means for reciprocating said piston within said chamber to cause the piston to repetitively strike said anvil, and means for receiving blows from said anvil and transmitting such blows to a pipe to be driven.

12. The pipe hammer of claim 11 wherein said inner sleeve is fixed to said end cap by clamp means, said clamp means being positoned radially outwardly of said inner sleeve bore, and comprising mutually interengaging shoulders on said inner sleeve and end cap and sleeve retainer means for pressing said shoulders against one another.

13. The pipe hammer of claim 12 including means for restraining relative rotation of said sleeves.

14. The pipe hammer of claim 13 wherein said means for restraining relative rotation comprises axially extending mating recesses in said retainer means and in said inner sleeve, and a pin captured in said recesses.

* * * * *